US007549778B2

(12) United States Patent
Chien

(10) Patent No.: US 7,549,778 B2
(45) Date of Patent: Jun. 23, 2009

(54) WORK LIGHT STRUCTURE

(76) Inventor: Chao Chuan Chien, 8F, No. 387, Chung Cheng Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 11/980,770

(22) Filed: Oct. 31, 2007

(65) Prior Publication Data

US 2008/0239730 A1 Oct. 2, 2008

(30) Foreign Application Priority Data

Dec. 4, 2006 (TW) ..... 95221301 U
Aug. 6, 2007 (TW) ..... 96212879 U

(51) Int. Cl.
*F21V 33/00* (2006.01)

(52) U.S. Cl. ..... 362/396; 362/220; 362/221; 362/225; 362/250; 362/287; 362/427

(58) Field of Classification Search ..... 362/219, 362/220, 221, 222, 223, 224, 225, 396, 427, 362/428, 287, 197, 199, 250
See application file for complete search history.

(56) References Cited

U.S. PATENT DOCUMENTS 2,369,123 A * 2/1945 Abshire ..... 250/455.11
2,465,414 A * 3/1949 Abshire ..... 313/51
4,197,573 A * 4/1980 Thatch ..... 362/241
4,658,337 A * 4/1987 Burke ..... 362/225
6,799,863 B2 * 10/2004 Offiler et al. ..... 362/220
6,979,100 B2 * 12/2005 Reiff et al. ..... 362/184
7,258,459 B2 * 8/2007 Wang ..... 362/101

* cited by examiner

*Primary Examiner*—Laura Tso
(74) *Attorney, Agent, or Firm*—Guice Patents PLLC

(57) ABSTRACT

A work light structure according to the present invention comprises: a light source module having a long slender housing laterally and inwardly connected with a printed circuit board so as to partition the housing into a lighting portion and an accommodating portion, the printed circuit board being coupled with a plurality of light emitting diodes (LEDs) arranged in line inside the lighting portion and each of the two ends of the housing is connected with an end cap, respectively, for capping the ends, and one of the end caps is disposed with a power supply device; an extension device disposed in the accommodating portion and formed by connecting at least a resilient component with its two ends onto a connecting rod, respectively, whose external end is inserted through a rod hole at the end cap and is connected with an externally protruding hook; the two hooks are hooked onto two ends of a connecting object to extend the resilient component, such that the power supply device may provide power to the printed circuit hoard to light up the LEDs.

22 Claims, 14 Drawing Sheets

A-A

B-B

C-C

D-D

E-E

F-F

WORK LIGHT STRUCTURE

FIELD OF THE INVENTION

The present invention relates to a work light structure and in particular to a work light structure in which its light source module is disposed with an extension device with its two ends connected with a hook, respectively, to be hooked onto two sides of a connecting object. Further, the present invention provides a foldable work light structure to significantly reduce its length which is conducive to carrying away and storage.

BACKGROUND OF THE INVENTION

Lamp has a variety of forms to suit its usage, floor lamp, wall lamp, table lamp, desk lamp, and many others. To meet the demand of a working site, the design of a lamp usually requires specific functions. For a car maintenance workshop, for example, the lamps on the workshop usually do not satisfy the need of the maintenance work since the car body or cover, an engine hood or a trunk cover for example, may obstruct the light coming from the lamps on top, and thus the lamps cannot light the area required. Consequently, the emergence of work light is to meet this specific demand. A conventional work light usually uses a tungsten wire as light source covered with a mesh metal cage thereon for the protection of its bulb. A hook is disposed on its end for hanging the lamp at the maintenance site to provide the lighting. Although the conventional work light can provide the lighting at the maintenance work area, it can only provide lighting to a restricted area due to its dimension. Also, the light provided by the conventional work light is yellow light, which cannot provide the required area and strength of illumination.

Recently, light emitting diode (LED) has increasingly been chosen to replace conventional light as a popular light source for its compact size, energy saving capability, and long service life. Therefore, some companies have used LEDs as a work light. The LED work light is a long-slender light source module (which comprises LEDs, a printed circuit board, a transparent shade, and a housing) with its two ends connected with a respective ring body over which is connected with a fixing plate, and the fixing plate is socketingly connected with a respective slide rail. When the work light is being used, the two slide rails are hooked, respectively, onto two ends of a connecting object, an engine hood for example, and the fastening part on the fixing plate is tightened to press against the slide rail so as to achieve the positioning of the fixing plate and the slide rail.

Although the slide-rail work light may provide white light for a larger area of illumination, one of its drawbacks is that since the height of the light source module, the ring body, and the slide rail is relatively large, the work light is not useful if the maintenance space is restricted. Furthermore, the connection procedure for connecting the work light and the connecting object is tedious and complicated, which requires positioning as well as fixing. The design of such a work light is thus defective and demands improvements.

SUMMARY OF THE INVENTION

To meet such a demand, the applicant having a long time experience in designing, production, and marketing of the power supply device and lamp design proposes the present invention, a work light structure, as a result of numerous trials and experiments.

An object of the present invention is to provide a work light structure whose extension device is enclosedly accommodated and thus concealed in the accommodating portion of the housing and thus when extending or retracting, the resilient component will not be hindered by foreign objects; with the extension and retraction of the resilient component, the two hooks on either end can easily and quickly hook onto a connecting object and the work light structure can be positioned thereon.

In order to accomplish the objects described above, the present invention is to provide a work light structure comprising: a light source module having a long slender housing laterally and inwardly connected with a printed circuit board so as to partition the housing into a lighting portion and an accommodating portion, the printed circuit board being coupled with a plurality of light emitting diodes (LEDs) arranged in line inside the lighting portion and each of the two ends of the housing is connected with an end cap, respectively, for capping the ends, and one of the end caps is disposed with a power supply device; an extension device disposed in the accommodating portion and formed by connecting at least a resilient component with its two ends onto a connecting rod, respectively, whose external end is inserted through a rod hole at the end cap and is connected with an externally protruding hook; the two hooks are hooked onto two ends of a connecting object to extend the resilient component, such that the power supply device may provide power to the printed circuit board to light up the LEDs.

The other object of the present invention is to provide a work light structure with folding and extending functions, which is conducive to carrying away and storage, in particular being stored in a car trunk without taking up too much space. Further, the work light structure in accordance with the present invention after folding can be connected onto a tripod to become a stand light, thereby enhancing the versatile functions of the present invention.

In order to accomplish the objects described above, the present invention provides a work light structure, comprising two light source modules each of which having a long slender housing laterally and inwardly connected with a printed circuit board so as to partition the housing into a lighting portion and an accommodating portion, the printed circuit board being coupled with a plurality of light emitting diodes (LEDs) arranged inside the lighting portion, and the outer ends the two light source modules being connected with an end cap, respectively, one of which is disposed with a power supply device therein; two extension devices disposed in the accommodating portions of the two light source modules and formed by socketingly connecting a resilient component with a connecting rod whose inner end is disposed with a spring stop and whose outer end extends through the end cap to be connected with an externally protruding hook; one folding part formed by pivotally connecting the two ends of a fixed frame with a rotating frame, respectively, which is further connected with the inner ends of the light source modules, which are electrically connected with an electrical cord, such that each light source module along with its respectively connected rotating frame can rotate with respect to the fixed frame, and thus extend or fold; consequently, the two hooks may be hooked onto two ends of a connecting object to extend the resilient component, and the power supply device may provide power to the printed circuit board to light up the LEDs.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
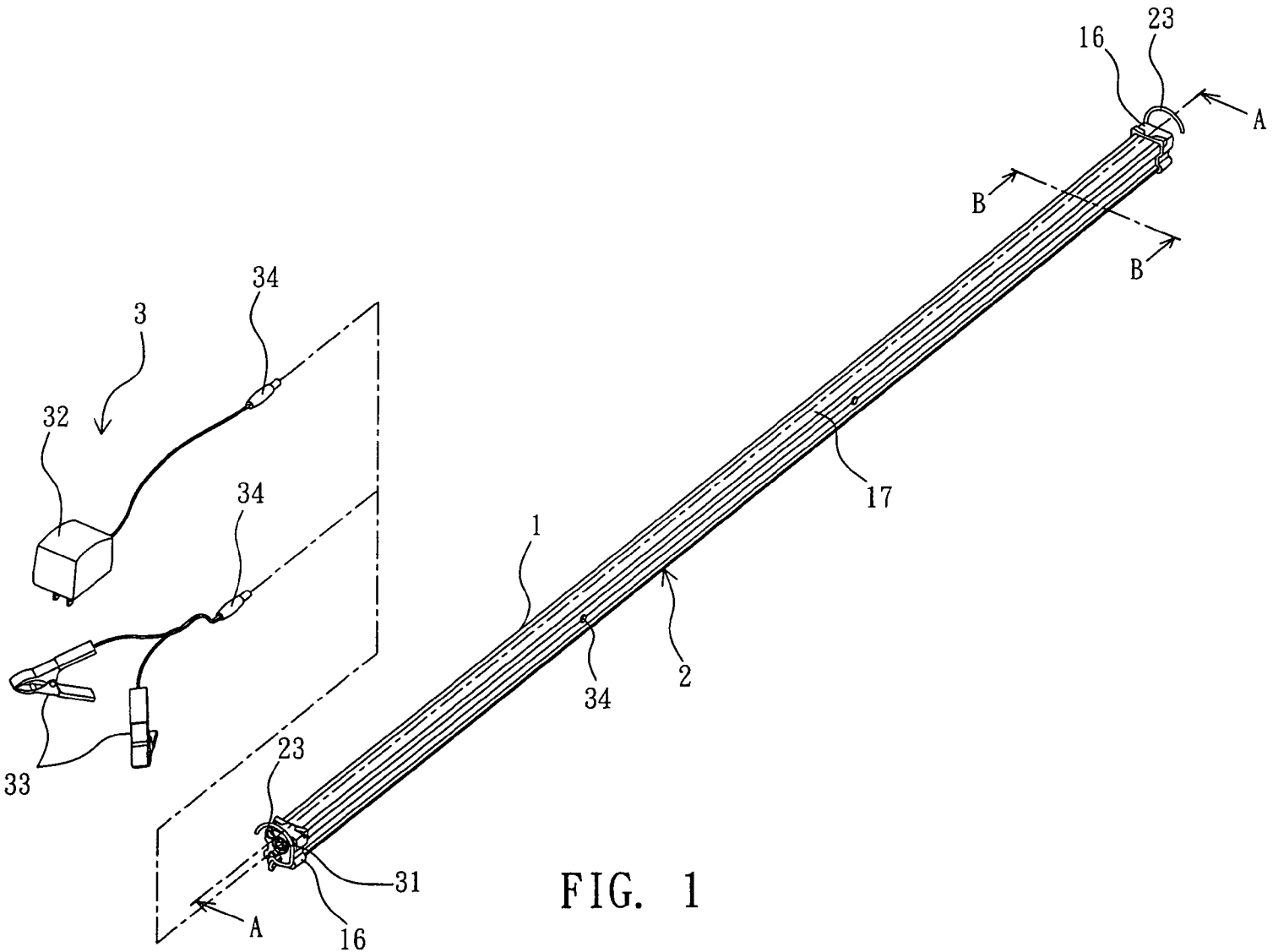
FIG. 1 is a perspective view of a work light structure of the present invention.
Figure 2:
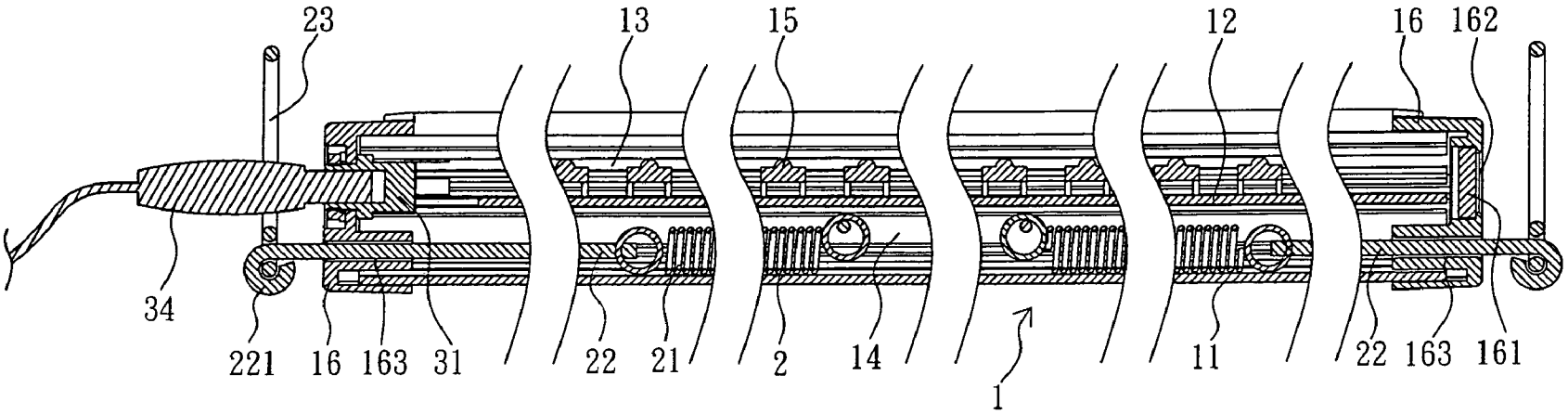
FIG. 2 is a cross-sectional view of Section A-A of FIG. 1.
Figure 3:
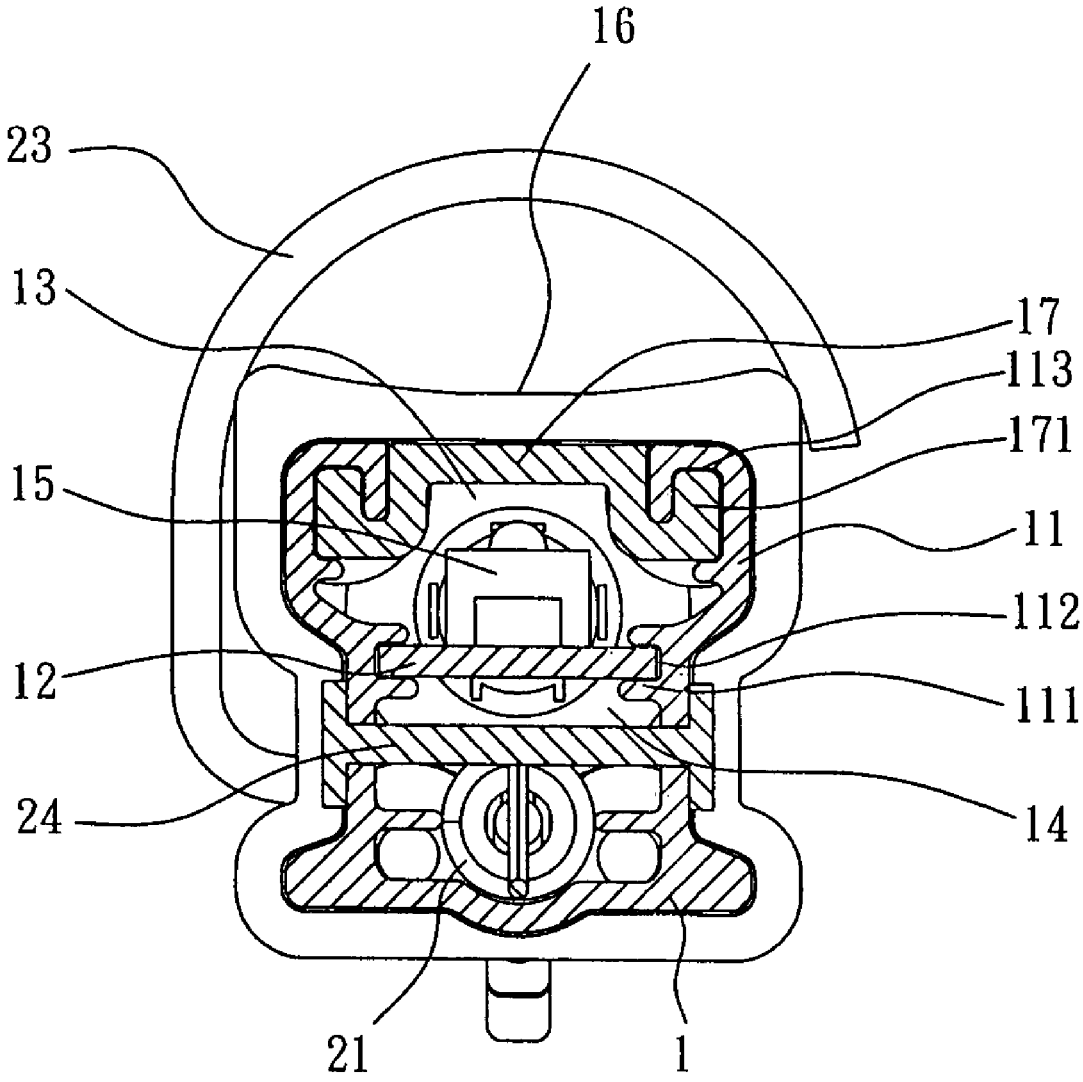
FIG. 3 is a cross-sectional view of Section B-B of FIG. 1.

With reference to FIGS. 1 to 3, a work light according to the present invention comprises a light source module 1 and an extension device 2, wherein the light source module 1 comprises a long slender housing 11 formed by extruding of aluminum or injection molding of plastics, for example, and laterally connected a printed circuit board 12 which is also a shape of long slender such that the housing 11 is partitioned into a lighting portion 13 and an accommodating portion 14. The printed circuit board 12 is coupled with a plurality of light emitting diodes (LEDs) 15 arranged in line inside the lighting portion 13, and the accommodating portion 14 is reserved for the extension device 2 described later. When the light source module 1 is assembled, each of the two ends of the housing 11 is connected with an end cap 16, respectively, for capping the ends, wherein one of the end caps 16 is disposed with a power supply device 3, a battery for example, for supplying power to enable the printed circuit board 12 to light up the light emitting diodes 15 when no power cord is available; however, the power supply device 3 is not limited to a battery, it may also be a power input socket 31 for the insertion of a power output plug 34 of a transformer 32 or two battery clips 33 such that the printed circuit board 12 may acquire power to light up the light emitting diodes 15. In fact, the end cap 16 may also be incorporated with a switch (a conventional art, not shown) to control on/off of the power. Furthermore, the other end cap 16 may be connected with a magnetic object 161 therein and a through hole 162 of smaller diameter is formed on the end cap 16 adjacent to the magnetic object 161 for recovering little objects, screws for example, falling from gaps around the engine during, for example, maintenance work.

With reference to FIG. 3, the housing 11 is roughly a H shape, wherein a pair of mating tenons 111 are inwardly disposed at the opposite wall in the neck of the middle section so as to form a slender slot 112 for the inserting and positioning of the printed circuit board 12. Also, the opening of the lighting portion 13 is connected with a transparent shade 17 to protect the LEDs 15; the two ends of the transparent shade 17 are formed to have two hook-shape shade tenons 171 such that the shade tenons 171 may be inserted into slots 113 formed at two sides of the opening.

The extension device 2 is formed by at least a resilient component 21, a spring for example disposed in the accommodating portion 14, with its two ends connected with a connecting rod 22, respectively, whose external end is inserted through a rod hole 163 pre-formed at the end cap 16 and is formed to have an end ring 221 larger than the diameter of the rod hole 163, such that the end rings 221 will not retract back into the accommodating portion 14 to lose the function of extension. The ends of the end ring 221 are connected with a hook 23 to have the function of hanging objects, which may dangle freely.

In case the structure of a work light according to the present invention is somewhat long, 100 cm for example, the resilient component 21 will be relatively long; it is then preferably to use two resilient components 21 to cut the cost. To fix the internal ends of the resilient components 21, a fixing pin is radially inserted at the housing 11 corresponding to the two sides of the roughly middle section of the accommodating portion 14, respectively, to be connected with the respective internal ends of the resilient components 21. The external end of the respective resilient component 21 is connected with a connecting rod 22, as described earlier, and the ends of the end ring 221 are further connected with a hook 23, respectively, to have the expected functions of resilient extension and hook positioning.

Figure 4:
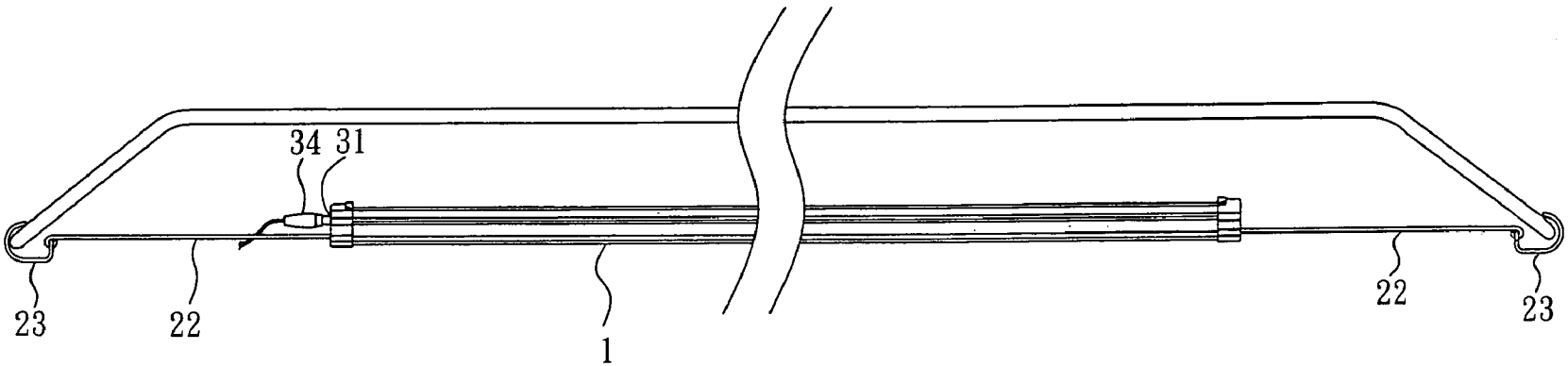
FIG. 4 is a perspective view of the connection between a work light structure of the present invention and a connecting object.

With reference to FIG. 4, when the present invention is being used, the hook 23 on one end of the work light structure according to the present invention is hooked onto a connecting object, an engine hood for example, through the extension of the resilient component 21. Then, the hook 23 on the other end is pulled to extend the resilient component 21 at the same side and thus is able to be conveniently hooked onto the other side of the engine hood. At this time, the light source module 1 is fixed between two ends of the car engine hood. The power output plug 34 of the transformer 32 is directly inserted into the power input socket 31; alternatively, the two clips 33 of a battery are pivotally connected with the two poles of a battery, and the power output plug 34 on the other end is directly inserted into the power input socket 31. The power may then be supplied to the light source module 1 and the LEDs 15 can be lit on directly, or through a switching action of a switch, to provide lighting to maintenance areas. Furthermore, since the work light structure according to the present invention is relatively small in height, i.e., a slender rectangle, when fine metal parts, screw, nut, washer, and others for example, fall into slots unintentionally, maintenance staffs may insert the end with the magnetic object 161 into gaps to recover the fallen objects, which cannot be achieved with the conventional art.

FIGS. 5 to 8 schematically show a work light structure in accordance with the other embodiment of the present invention, comprising two light source modules 1, two extension devices 2, and a folding part 4.

Figure 5:
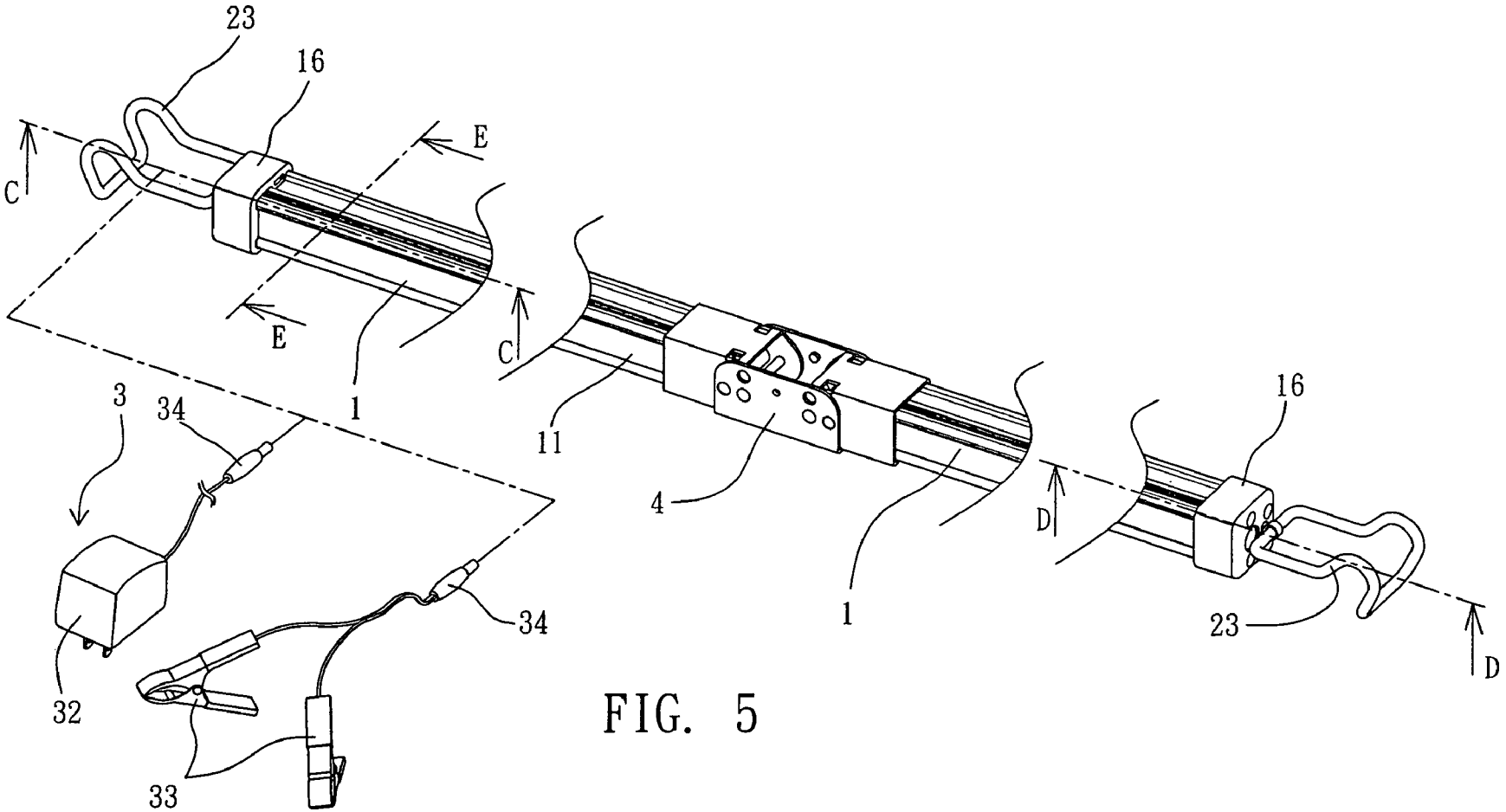
FIG. 5 is a perspective view of a work light structure in accordance with the other embodiment of the present invention.
Figure 6:
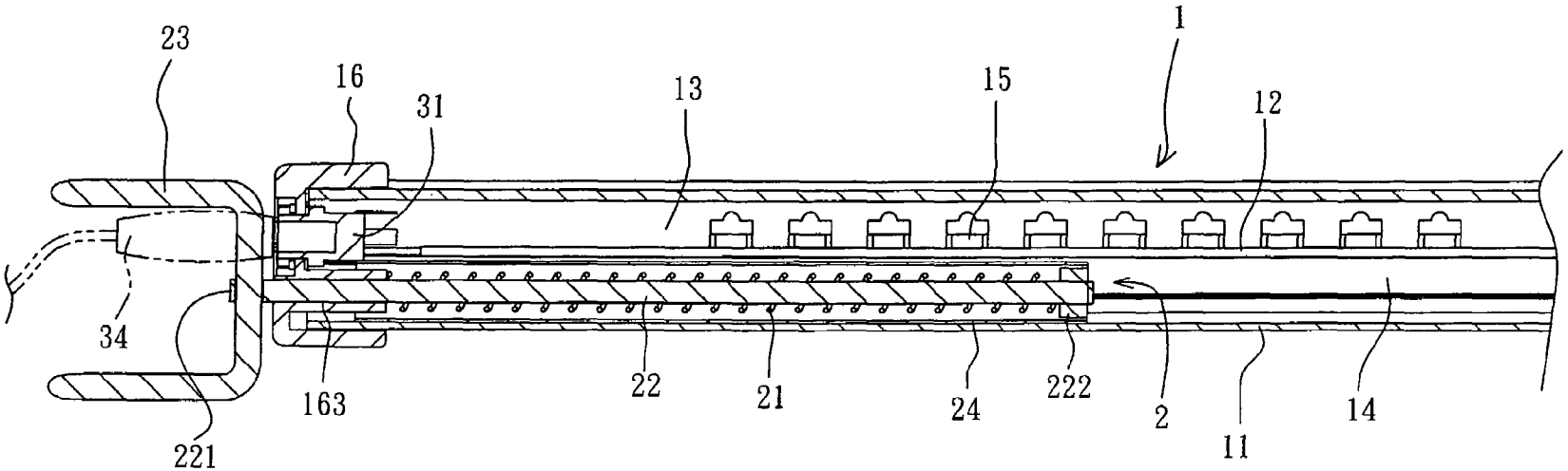
FIG. 6 is a cross-sectional view of Section C-C of FIG. 5.
Figure 7:
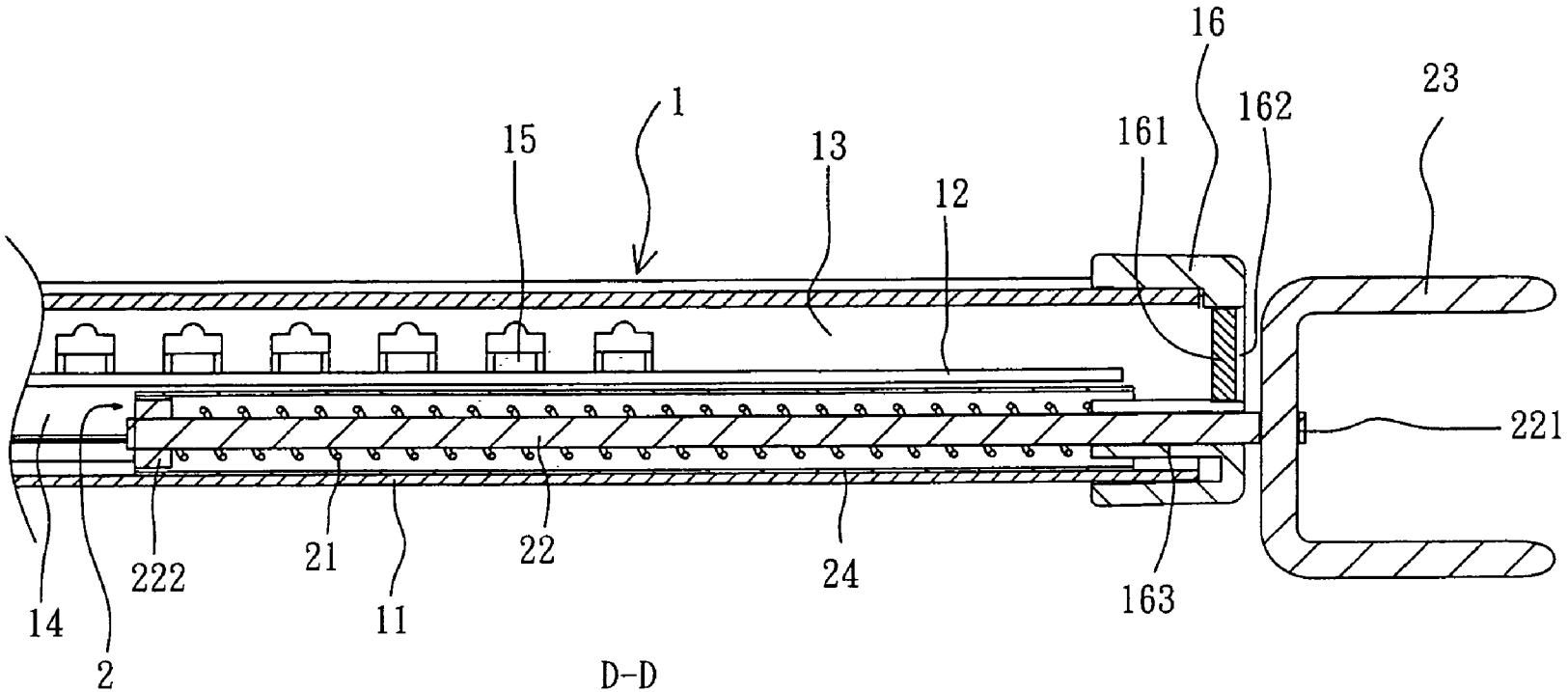
FIG. 7 is a cross-sectional view of Section D-D of FIG. 5.
Figure 8:
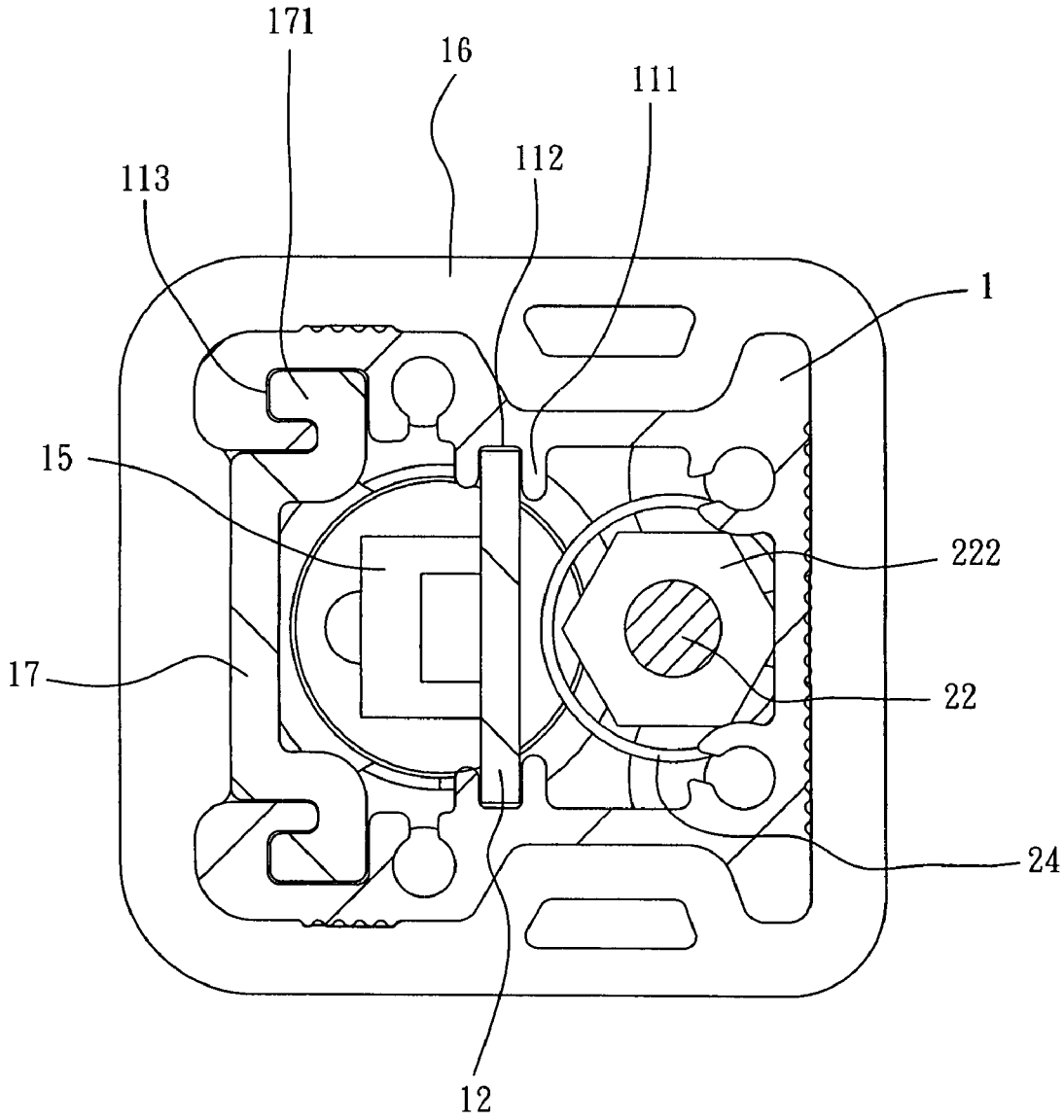
FIG. 8 is a cross-sectional view of Section E-E of FIG. 5.
Figure 11:
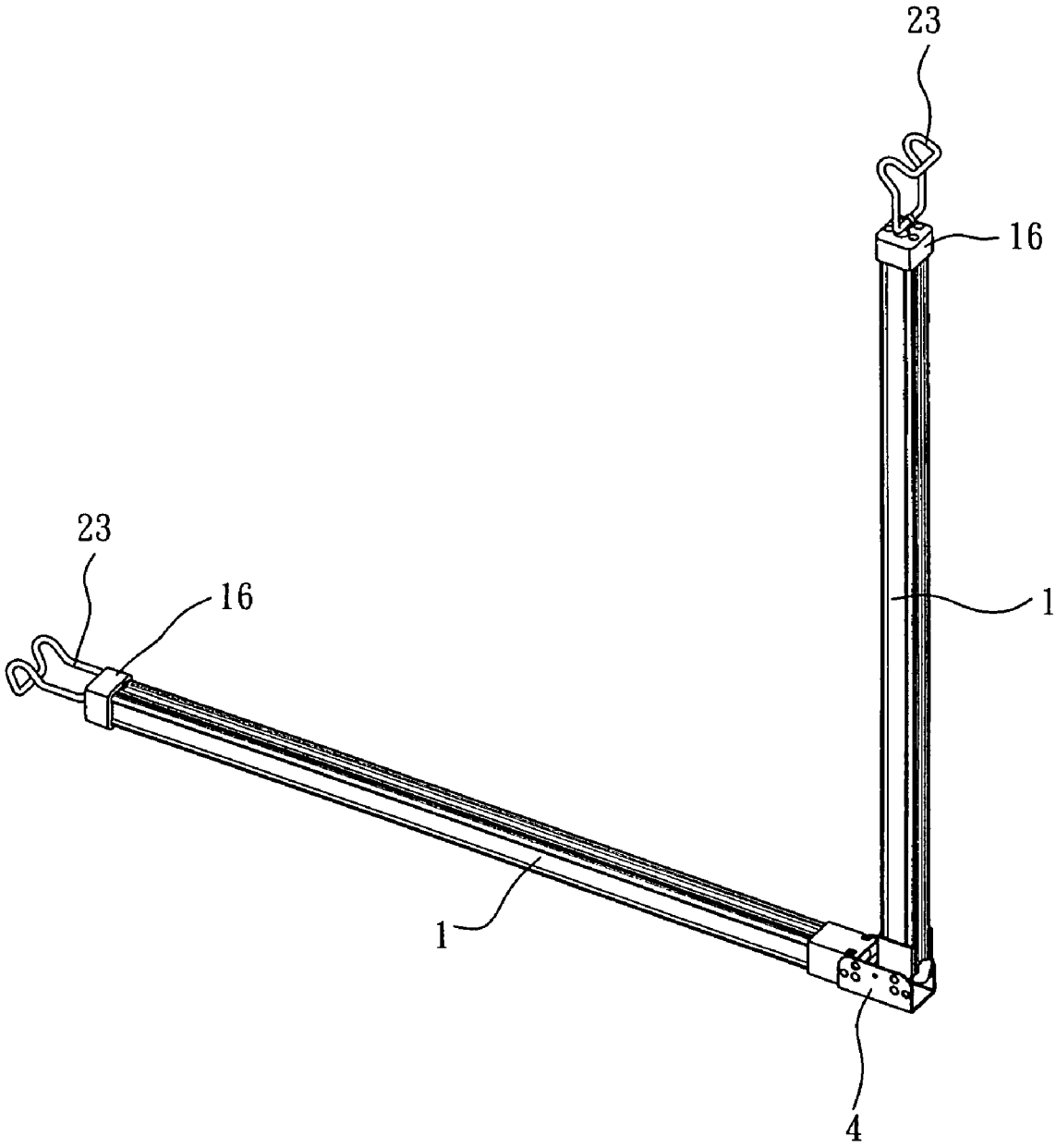
FIG. 11 is a perspective view of the other embodiment of the present invention being folded into a inter-perpendicular arrangement (parted by 90 degrees)
Figure 12:
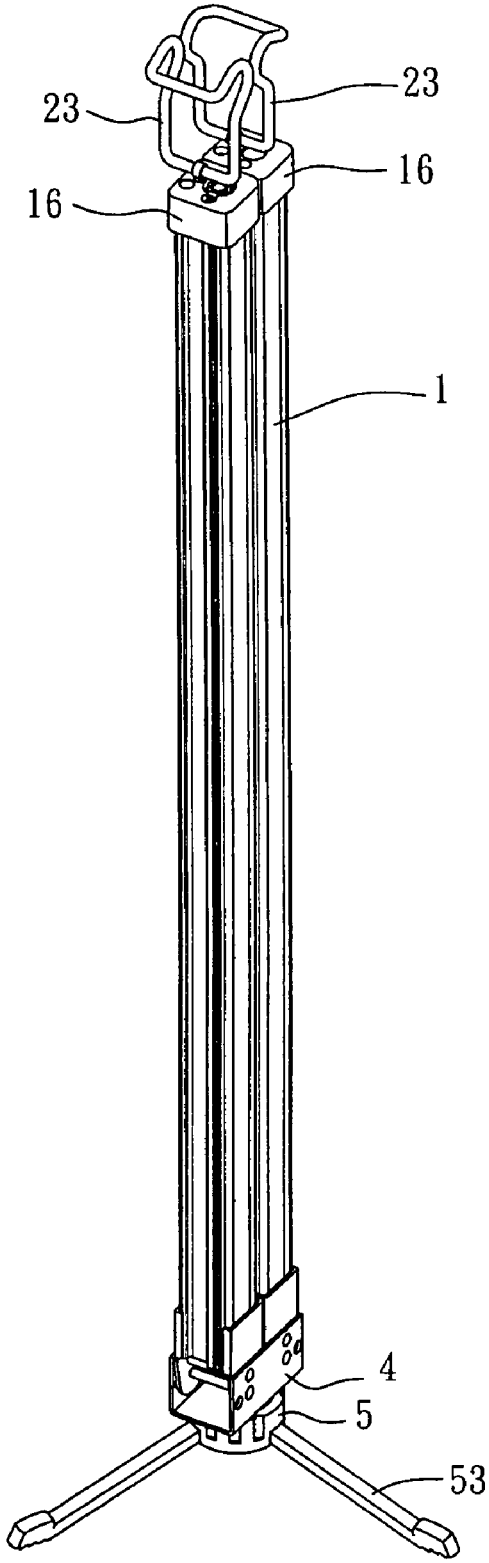
FIG. 12 is a perspective view of the other embodiment of the present invention being folded into a parallel arrangement (parted by zero degree) and connected with a tripod.

The two light source modules 1 are disposed symmetrically and pivotally connected with the folding part 4 therebetween to form an integrated body, such that light source modules 1 may form as a linear extended arrangement (parted by 180 degrees) shown in FIG. 5, or as a perpendicular arrangement (parted by 90 degrees) shown in FIG. 11, or even as a parallel folded arrangement (parted by zero degree) shown in FIG. 12, wherein the individual light source module 1 is in general identical to that described in the previous embodiment and will not be discussed here furthermore.

Each of the two extension devices 2 disposed at the open end of the accommodating portion 14 of the light source module 1, respectively, is formed by a resilient component 21, a spring for example, socketingly connected with a connecting rod 22 whose inner end is disposed with a spring stop 222, a screw nut for example, to compress the resilient component 21 and whose outer end is inserted through a rod hole 163 pre-formed at the end cap 16 and is formed to have an end ring 221 larger than the diameter of the rod hole 163, such that the end ring 221 will not retract back into the accommodating portion 14 to lose the function of extension. The end of the end ring 221 is connected with a hook 23, respectively, to provide the function of hanging objects, which may dangle freely. As shown in the figures described above, the hook 23 is a double hook whose spacing is equal to the size of the end cap 16 such that when not in use, the hook 23 can be clamped on its neighboring end cap 16 to be secured thereon. Further, to avoid short cut resulted from the contact between the extension device 2 and the printed circuit board 12, an insulated sheath 24 is covered over the resilient component 21, the connecting rod 22, and the spring stop 222 in the accommodating portion 14.

Figure 9:
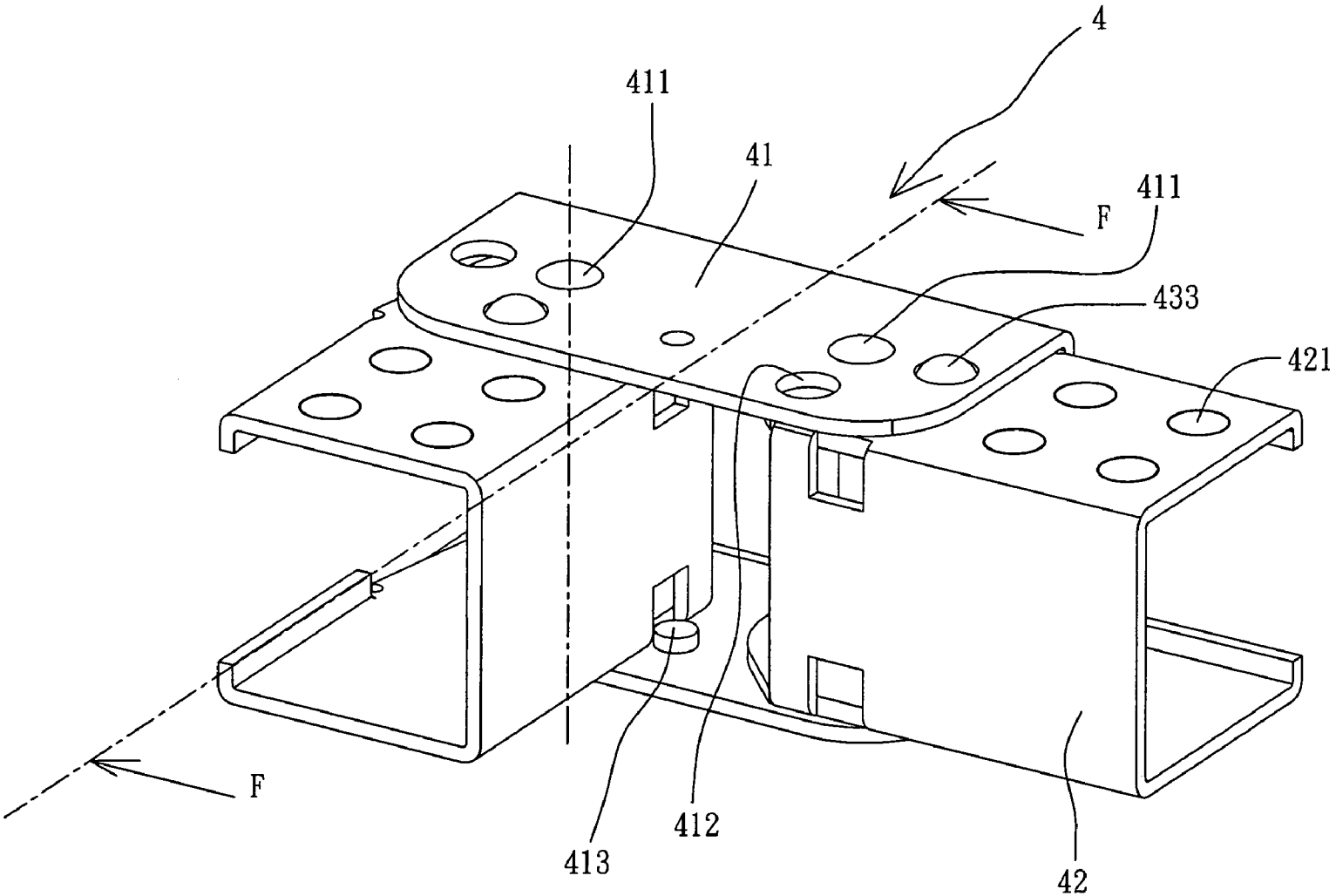
FIG. 9 is a perspective view of a folding part in accordance with the other embodiment of the present invention.
Figure 10:
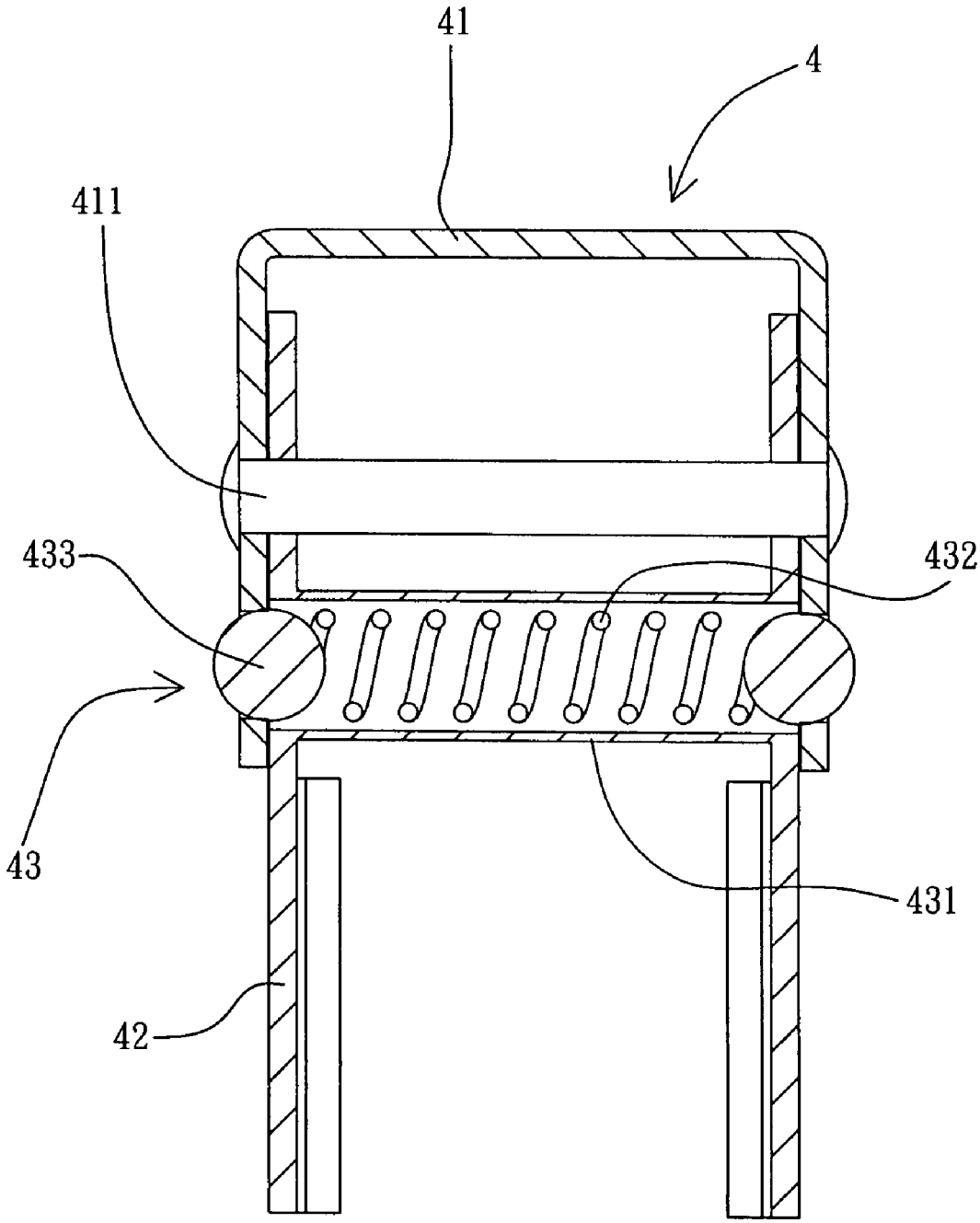
FIG. 10 is a cross-sectional view of Section F-F of FIG. 9.

With reference to FIGS. 9 and 10, the folding part 4 is formed by two rotating frame 42 pivotally connected onto two ends of a fixed frame 41 with a pivot 411, respectively. Each of the two light source modules 1 is connected with its respective rotating frame 42 at its inner end and conventional connecting parts, screws for example, are inserted through a through hole 421 pre-formed at the wall of the rotating frame 42 and secured onto the housing 11. The two light source modules 1 are electrically connected with an electrical cord (not shown). To make the rotating frame 42 positioned against the fixed frame 41, each rotating frame 42 is longitudinally disposed with a positioning structure 43 therein, respectively, which is formed by a sleeve 431 disposed between the two walls of the frames, a resilient element 432, a spring for example, inserted in the sleeve 431, and a ball 433 wedgingly mounted on the open ends of the sleeve 431, respectively. The top and bottom walls of the fixed frame 41 corresponding to the moving path of the ball 433, at the horizontal and perpendicular directions of the pivot 411 for example, are fabricated to have a pair of positioning holes 412, such that when the rotating frame 42 rotates, the upper and lower balls 433 are engaged at the pair of pre-formed positioning holes 412 to render the rotating frame 42 positioned thereon. Further, the top and bottom walls of the fixed frame 41 is protrudingly and inwardly disposed with a pair of opposite stop blocks 413 slightly away from its center to work as the inward rotating limits of the two rotating frames 42.

With reference to FIG. 5, the two light source modules 1 can be pulled to rotate the two rotating frames 42 inside the fixed frame 41, such that the light source modules 1 are arranged in a linear extended arrangement (parted by 180 degrees) and the hook 23 on its one end can be extended to hook onto the connecting object, one end of a car engine for example, and the hook 23 on the other end can be pulled to hook onto the other end of the car engine, such that the light modules are secured between the two ends of the car engine. The power output plug 34 of the transformer 32 is directly inserted into the power input socket 31; alternatively, the two battery clips 33 are pivotally connected with the two poles of a battery, and the power output plug 34 on the other end is directly inserted, into the power input socket 31. The power may then be supplied to light on the LEDs 15 directly, or through the switching action of a switch, to provide lighting for maintenance areas. Furthermore, since the work light structure in accordance with the present invention is relatively small in height, i.e., a slender rectangle, when fine metal parts, screw, nut, washer, and others for example, fall into slots unintentionally, maintenance staffs may insert the end cap 16 with a magnetic object 161 into gaps to recover the fallen objects, which cannot be achieved with the conventional art.

With reference to FIG. 11, one of the light source modules 1 is pulled with respect to the other one so that they are in a perpendicular arrangement (parted by 90 degrees), which can provide lighting to situations such as changing tires.

With reference to FIG. 12, one of the light source modules 1 is pulled to rotate the two rotating frames 42 inside the fixed frame 41 so that they are in a parallel folded arrangement (parted by zero degree), which can double the strength of lighting. A tripod 5 is provided thereunder to enable the work light standing upright.

Figure 13:
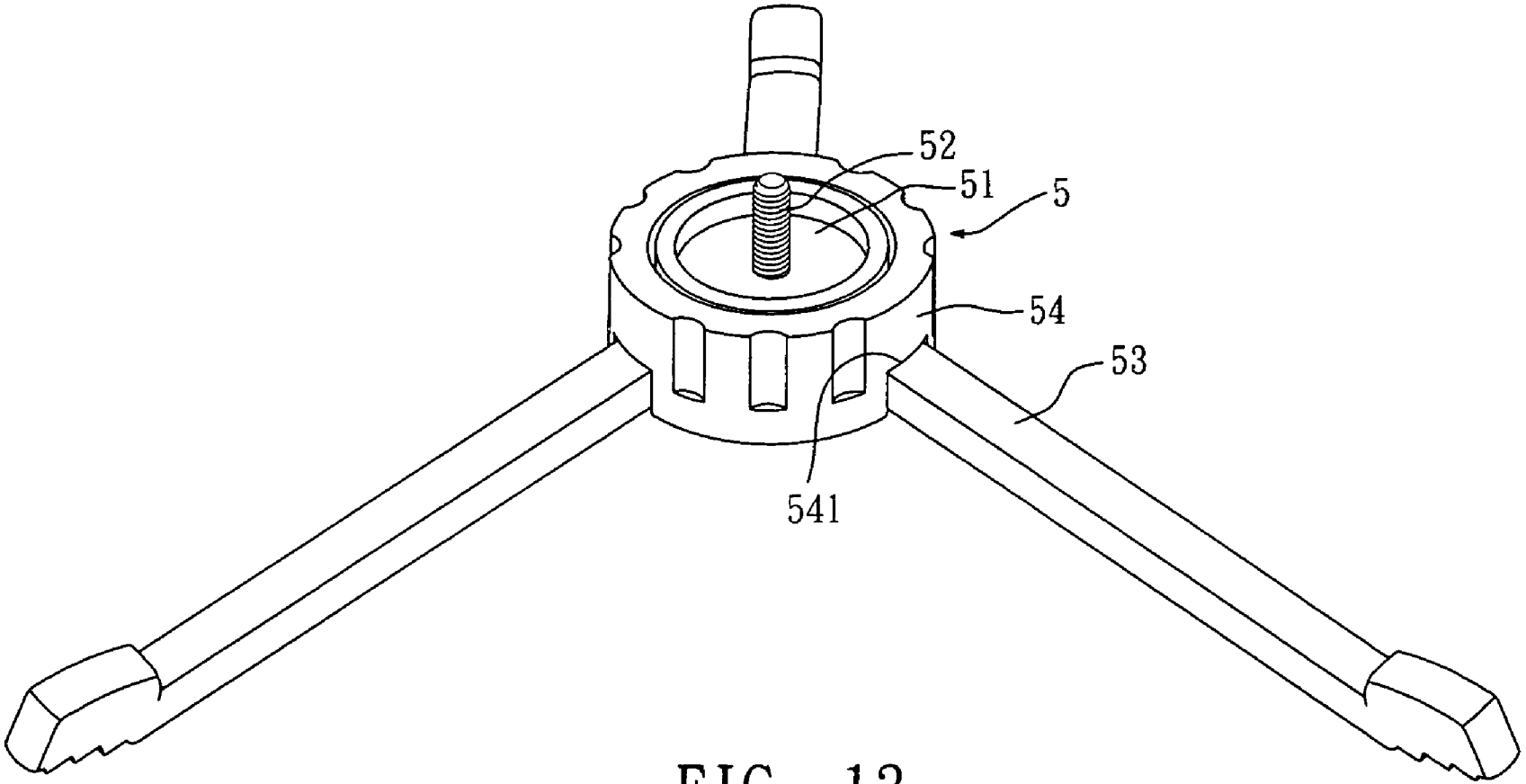
FIG. 13 is a perspective view of a tripod in accordance with the other embodiment of the present invention being extended.
Figure 14:
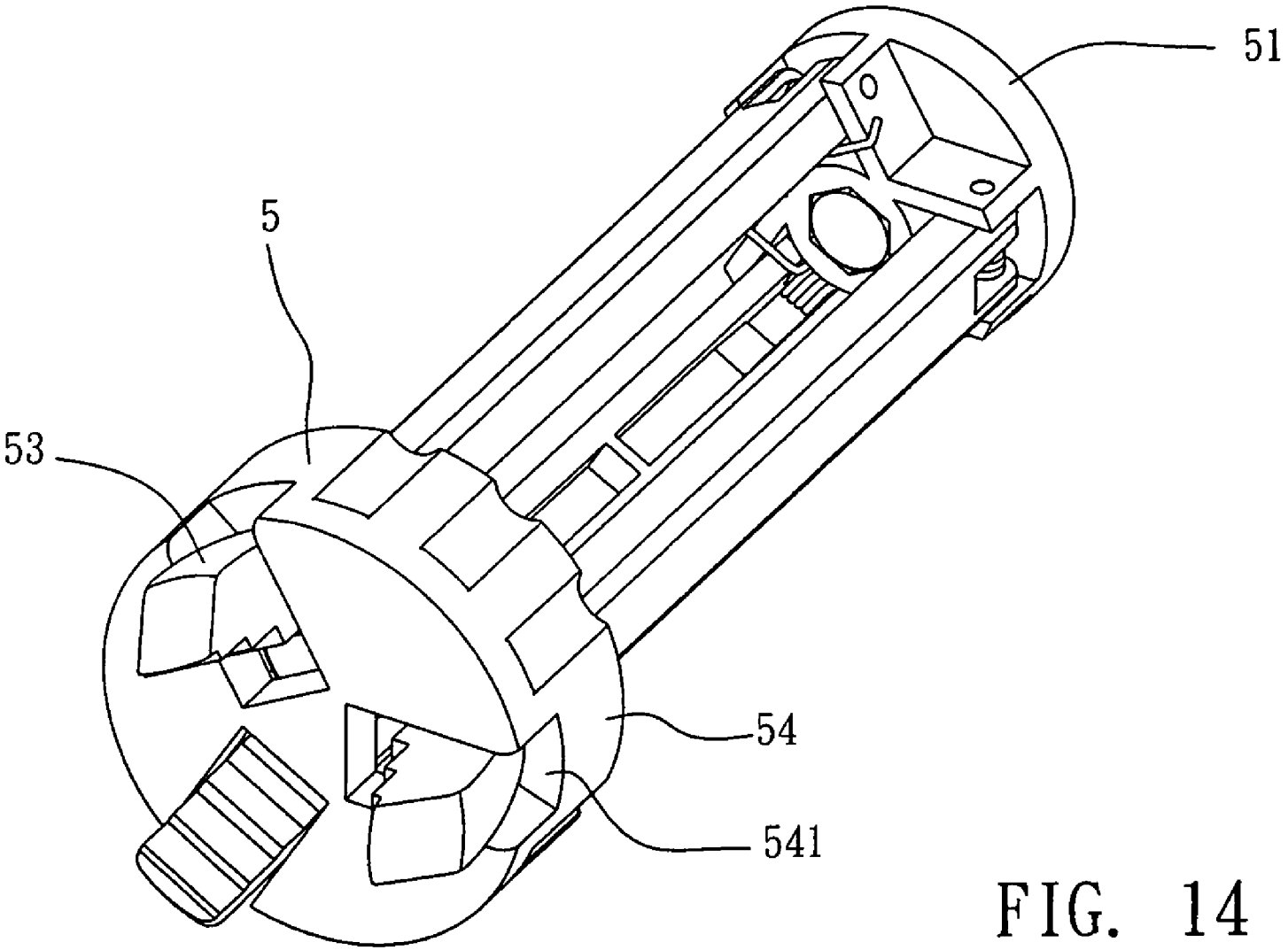
FIG. 14 is a perspective view of a tripod in accordance with the other embodiment of the present invention being retracted.

With reference to FIGS. 13 and 14, the supporting part 51 at the top of the tripod 5 is disposed with a connecting portion 52, a screw for example, to be secured with a through hole pre-formed at the bottom of the fixed frame 41. The supporting part 51 is pivotally and resiliently connected with at least three supporting legs 53 isogonally distributed at its lower circumference, such that the supporting legs 53 can be extended or retracted. Further, the supporting legs 53 are socketingly connected onto corresponding slots 541, respectively, formed at the bottom of a retracting ring 54. When the retracting ring 54 is moved to contact with the supporting part 51, the supporting legs 53 can be fully extended such that the base area is increased to support the work light connected at the top.

Consequently, with the implementation of the present invention, the extension device is enclosedly accommodated in the accommodating portion and thus its extension or retraction will not be hindered by foreign objects. Furthermore, the present invention may quickly be hooked with its both ends onto a connecting object for positioning, which offers obvious advantage over the conventional art of work light, for which a somewhat tedious adjustment is required for positioning. Also, the work light structure according to the present invention is a slender rectangle without any connecting parts around, and thus its one end with the magnetic object can be inserted into gaps to recover any falling metal parts, which makes full use of the feature of its shape. Further, according to the other embodiment of the present invention, the two oppositely disposed light source modules are pivotally connected with a folding part to form an integrated body, in which the two light source modules can form a linear extended arrangement (parted by 180 degrees), a perpendicular arrangement (parted by 90 degrees), or even a parallel folded arrangement (parted by zero degree). This novel design of the relative arrangement the two light source modules described in the present invention is indeed not seen before in the field of work light.

While the invention has been described with reference to the a preferred embodiment thereof, it is to be understood that modifications or variations may be easily made without departing from the spirit of this invention, which is defined by the appended claims.

What is claimed is:

1. A work light structure comprising:

a light source module having a long slender housing laterally and inwardly connected with a printed circuit board so as to partition the housing into a lighting portion and an accommodating portion, the printed circuit board being coupled with a plurality of light emitting diodes (LEDs) arranged in line inside the lighting portion with each of the two ends of the housing is connected with an end cap, respectively, for capping the ends, and one of the end caps disposed with a power supply device; and an extension device disposed in the accommodating portion and formed by connecting at least a resilient component with its two ends onto a connecting rod, respectively, whose external end is inserted through a rod hole at the end cap and is connected with an externally protruding hook;

the two hooks are hooked onto two ends of a connecting object to extend the resilient component, such that the power supply device may provide power to the printed circuit board to light up the LEDs.

2. The work light structure as claimed in claim 1, wherein the housing is formed by extruding of aluminum or injection molding of plastics.

3. The work light structure as claimed in claim 1, wherein the power supply is a battery.

4. The work light structure as claimed in claim 1, wherein the power supply device is a power input socket and the power output plug on one end of a transformer is inserted into the power input socket.

5. The work light structure as claimed in claim 1, wherein the power supply device is a power input socket, and two battery clips are pivotally connected with two poles of a battery and the power output plug on the other end is inserted into the power input socket.

6. The work light structure as claimed in claim 1, wherein a magnetic object is disposed in the other end cap of the light source module and the end cap adjacent to the magnetic object is formed to have a through hole of smaller diameter.

7. The work light structure as claimed in claim 1, wherein a pair of mating tenons are inwardly disposed at the opposite wall in the neck of the middle section so as to form a slender slot for the inserting and positioning of the printed circuit board.

8. The work light structure as claimed in claim 1, wherein further comprising a transparent shade, which is connected onto the opening of the lighting portion of the light source module.

9. The work light structure as claimed in claim 1, wherein two ends of the transparent shade are formed to have two hook-shape shade tenons such that the shade tenons may be inserted into slots formed at two sides of the opening of the lighting portion.

10. The work light structure as claimed in claim 1, wherein there are two resilient components and the a fixing pin is radially inserted at the housing corresponding to the two sides of the roughly middle section of the accommodating portion, respectively, to be connected with the respective internal ends of the resilient components, each of which is connected with a connecting rod at its end and is further disposed with a hook at the end of the connecting rod.

11. A work light structure comprising:

two light source modules each of which having a long slender housing laterally and inwardly connected with a printed circuit board so as to partition the housing into a lighting portion and an accommodating portion, the printed circuit board being coupled with a plurality of light emitting diodes (LEDs) arranged inside the lighting portion, and two outer ends of the two light source modules being connected with an end cap, respectively, one of which is disposed with a power supply device therein;

two extension devices disposed in the accommodating portions of two light source modules and formed by socketingly connecting a resilient component with a connecting rod whose inner end is disposed with a spring stop and whose outer end extends through the end cap to be connected with an externally protruding hook;

one folding part formed by pivotally connecting the two ends of a fixed frame with a rotating frame, respectively, which is further connected with the inner ends of the light source modules, which are electrically connected with an electrical cord, such that each light source module along with its respectively connected rotating frame can rotate with respect to the fixed frame, and thus extend or fold;

the two hooks are hooked onto two ends of a connecting object to extend the resilient component, and the power supply device may provide power to the printed circuit board to light up the LEDs.

12. The work light structure as claimed in claim 11, wherein the power supply device is a battery.

13. The work light structure as claimed in claim 11, wherein the power supply device is a power input socket and the power output plug on one end of a transformer is inserted into the power input socket.

14. The work light structure as claimed in claim 11, wherein the power supply device is a power input socket, and two battery clips are pivotally connected with two poles of a battery and the power output plug on the other end is inserted into the power input socket.

15. The work light structure as claimed in claim 11, wherein a magnetic object is disposed in the other end cap of the light source module and the end cap adjacent to the magnetic object is formed to have a through hole of smaller diameter.

16. The work light structure as claimed in claim 11, wherein a pair of mating tenons are inwardly disposed at the opposite wall in the neck of the middle section so as to form a slender slot for the inserting and positioning of the printed circuit board.

17. The work light structure as claimed in claim 11, further comprising a transparent shade, which is connected onto the opening of the lighting portion of the light source module and whose two ends of the transparent shade are formed to have two hook-shape shade tenons such that the shade tenons may be inserted into slots formed at two sides of the opening of the lighting portion.

18. The work light structure as claimed in claim 11, the connecting rod and the resilient component accommodated in the accommodating portion are covered with an insulated sheath.

19. The work light structure as claimed in claim 11, wherein each rotating frame is longitudinally disposed with a positioning structure, respectively, which is formed by a sleeve disposed between the two walls of the rotating frames, a resilient element inserted in the sleeve, and a ball wedgingly mounted on the open ends of the sleeve, respectively, and the top and bottom walls of the fixed frame corresponding to the moving path of the balls are fabricated to have a pair of positioning holes, such that when the rotating frame rotates, the upper and lower balls are engaged at the pair of preformed positioning holes.

20. The work light structure as claimed in claim 11, the top and bottom walls of the fixed frame is protrudingly and inwardly disposed with a pair of opposite stop blocks slightly away from its center to work as the inward rotating limits of the two rotating frames.

21. The work light structure as claimed in claim 11, further comprising a tripod whose supporting part at the top is disposed with a connecting part to be secured with a through hole pre-formed at the bottom of the fixed frame such that the light source modules can stand upright upon the tripod.

22. The work light structure as claimed in claim 21, wherein the supporting part is pivotally and resiliently connected with at least three supporting legs isogonally distributed at its lower circumference, and the supporting legs are socketingly connected onto corresponding slots formed at the bottom of a retracting ring, such that when the retracting ring is moved to contact with the supporting part, the supporting legs can be fully extended.

* * * * *